US012668908B2

(12) United States Patent
Park et al.

(10) Patent No.: US 12,668,908 B2
(45) Date of Patent: Jun. 30, 2026

(54) WASHING MACHINE

(71) Applicant: SAMSUNG ELECTRONICS CO., LTD., Suwon-si (KR)

(72) Inventors: Sangho Park, Suwon-si (KR); Kyungsub Sim, Suwon-si (KR); Dongwoon Lim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 232 days.

(21) Appl. No.: 18/525,526

(22) Filed: Nov. 30, 2023

(65) Prior Publication Data

US 2024/0093419 A1 Mar. 21, 2024

Related U.S. Application Data

(63) Continuation of application No. PCT/KR2022/010620, filed on Jul. 20, 2022.

(30) Foreign Application Priority Data

Aug. 4, 2021 (KR) ..... 10-2021-0102474

(51) Int. Cl.
*D06F 37/24* (2006.01)
*D06F 37/20* (2006.01)
*D06F 37/26* (2006.01)

(52) U.S. Cl.
CPC ..... *D06F 37/24* (2013.01); *D06F 37/206* (2013.01); *D06F 37/269* (2013.01)

(58) Field of Classification Search
CPC ..... D06F 37/24; D06F 37/206; D06F 37/269
See application file for complete search history.

(56) References Cited

U.S. PATENT DOCUMENTS 2,969,172 A * 1/1961 Hutt ..... D06F 37/24 74/572.4
3,116,813 A * 1/1964 Ziegler ..... D06F 37/24 68/23.3

(Continued)

FOREIGN PATENT DOCUMENTS

JP H0824790 B2 3/1996
JP H09170249 A 6/1997

(Continued)

OTHER PUBLICATIONS

International Search Report and Written Opinion of the International Searching Authority dated Nov. 21, 2022, in connection with International Application No. PCT/KR2022/010620, 10 pages.

*Primary Examiner* — Joseph L. Perrin

(57) ABSTRACT

Disclosed herein is a washing machine including a cabinet, a tub provided in the cabinet, a rotating tub rotatably provided in the tub, a shaft connected to rotate the rotating tub, a motor configured to rotate the shaft and including a rotor and a stator, a drip pan disposed at a lower end of the cabinet, and a friction member mounted on a lower end of the shaft and configured to contact with at least one surface of the drip pan, wherein the friction member includes a first portion secured to the shaft, a second portion connected to the first portion and having a curved surface in contact with the at least one surface of the drip pan.

20 Claims, 9 Drawing Sheets

(56) References Cited

U.S. PATENT DOCUMENTS 3,132,098 A * 5/1964 Bochan ..... D06F 49/06 74/572.4
3,304,950 A * 2/1967 Hubert ..... D06F 39/081 312/229
3,922,892 A 12/1975 Bochan
4,403,484 A * 9/1983 Fey ..... D06F 37/24 384/244
4,475,363 A * 10/1984 Thomson ..... D06F 37/24 68/23.3
4,814,752 A * 3/1989 Lehman ..... D06F 39/081 200/61.04
4,903,723 A * 2/1990 Sublett ..... A47L 15/421 4/251.1
5,452,739 A * 9/1995 Mustee ..... A47L 15/4212 4/251.1
5,934,107 A 8/1999 Lee et al.
5,946,947 A * 9/1999 Lee ..... D06F 37/24 68/23.1
8,393,351 B2 3/2013 Carter et al.
10,533,275 B2 1/2020 Im et al.
2015/0041270 A1 2/2015 Bae et al.
2016/0108575 A1* 4/2016 Lee ..... D06F 23/04 68/12.24
2020/0217001 A1 7/2020 Kang et al.
2022/0170197 A1* 6/2022 Kleindienst ..... D06F 39/125

FOREIGN PATENT DOCUMENTS

KR 100195442 B1 6/1999
KR 100229136 B1 11/1999
KR 100234057 B1 12/1999
KR 100598536 B1 7/2006
KR 20070095541 A 10/2007
KR 101104464 B1 1/2012
KR 101374399 B1 3/2014
KR 20150017889 A 2/2015
KR 20160053137 A 5/2016
KR 101698855 B1 1/2017
KR 20190089616 A 7/2019
KR 102476293 B1 12/2022

* cited by examiner

WASHING MACHINE

CROSS-REFERENCE TO RELATED APPLICATIONS

This application is a bypass continuation of International Application No. PCT/KR2022/010620, filed Jul. 20, 2022, which claims priority to Korean Patent Application No. 10-2021-0102474, filed Aug. 4, 2021, the disclosures of which are herein incorporated by reference in their entirety.

BACKGROUND

1. Field

The disclosure relates to a washing machine, and more particularly to a fully automatic washing machine.

2. Description of Related Art

In general, a washing machine is a home appliance that uses electric power to wash laundry, such as clothes. Such a washing machine may include, for example, a vortex-type washing machine, in which a pulsator provided inside a rotating tub rotates to generate a water flow and laundry is washed by the generated water flow, and a drum-type washing machine, in which laundry is washed by lifting and dropping the laundry with a lifter formed on an inner surface of a rotating tub.

A fully automatic washing machine typically uses a top-loading type, in which an opening is provided on an upper portion of a main body, to allow laundry to be put into a rotating tub, and a drum washing machine typically uses a front-loading type, in which an opening is provided on a front side of a main body, to allow laundry to be put into a rotating tub.

The fully automatic washing machine includes a cabinet forming an exterior thereof, a tub for receiving washing water, and a rotating tub for receiving laundry and is rotatably provided inside the tub. The tub is supported on the cabinet by a suspension device. At a lower portion of the tub, a driving device is provided. The driving device is disposed at a lower end of the tub and the rotating tub to rotate the rotating tub and a pulsator by using a driving force of a motor.

The fully automatic washing machine may be provided with a drip pan so as to protect a wooden floor and installation from moisture. When a washing process with stored water is performed in the fully automatic washing machine, the tub moves downward due to the weight of the laundry and water, and in turn a rotor of the driving device located at the bottom of the washing machine rotates. At this time, if there is no space between the rotor and the drip pan, the rotor and the drip pan become interfered with each other, causing noise.

SUMMARY

The present disclosure is directed to providing a washing machine capable of preventing noise.

Further, the present disclosure is directed to providing a washing machine capable of preventing interference between a rotor and a drip pan, thereby preventing noise and vibration caused by friction.

Further, the present disclosure is directed to providing a washing machine including a friction member having one contact point to minimize a contact surface between the rotor and the drip pan.

One aspect of the present disclosure provides a washing machine including a cabinet, a tub provided within the cabinet, a rotating tub rotatably provided within the tub, a shaft connected to rotate the rotating tub, a motor configured to rotate the shaft, the motor including a rotor and a stator, a drip pan disposed at a lower end of the cabinet, and a friction member mounted on a lower end of the shaft and configured to contact with at least one surface of the drip pan, wherein the friction member includes a first portion secured to the shaft, a second portion connected to the first portion and having a curved surface in contact with the at least one surface of the drip pan.

The first portion may be secured to a coupling portion formed at a first length at the lower end of the shaft, and a height of the first portion may correspond to the first length.

The second portion may extend downwardly from the first portion, and a height of the second portion may form a gap between the second portion and the at least one surface of the drip pan.

The second portion may include a hemispherical shape.

The second portion may further include a contact point provided on at least a portion of the curved surface and formed by point contact with the at least one surface of the drip pan.

The second portion may extend downwardly from the first portion, and further includes a rotatable ball.

The contact point may be formed by contact between the ball and the one surface of the drip pan.

A height ratio of the first portion and the second portion may be 1:1.5.

The drip pan may include a body provided corresponding to a lower portion of the cabinet to receive water falling from the cabinet, and an edge portion extending upwardly at an edge portion of the body, and the body may be inclined upwardly from the edge portion toward a center thereof.

The body may be elastically supported in a vertical direction to be deformable.

The body may include a first area in contact with the friction member, and a second area as a remaining area of the body except for the first area. The first area may have a different height than the second area.

The first area may be formed at a position lower than the second area by a second length, and the second length may be less than a height of the second portion.

The second length may be equal to or less than a height of the first portion.

Another aspect of the present disclosure provides a washing machine including a cabinet forming an exterior of the washing machine, a drip pan disposed at a lower end of the cabinet, a tub provided within the cabinet, a rotating tub rotatably provided within the tub, a shaft connected to rotate the rotating tub, a motor configured to rotate the shaft and including a rotor and a stator, and a friction member including a curved surface in contact with a surface of the drip pan.

The friction member may include a first portion secured to a lower end of the shaft, and a second portion connected to the first portion and having the curved surface in contact with the surface of the drip pan.

The first portion may be provided to be secured to a coupling portion formed at a first length 11 at the lower end of the shaft, and the height h1 of the first portion may correspond to the first length.

The second portion may extend downwardly from the first portion, and a height h2 of the second portion may form a gap between the second portion and the surface of the drip pan.

The second portion may have a hemispherical shape.

The second portion may extend downwardly from the first portion and further include a ball which is rotatable.

According to the spirit of the present disclosure, the washing machine may prevent interference between the rotor and the drip pan, thereby preventing noise and vibration caused by friction.

Further, according to the spirit of the present disclosure, the washing machine may include the friction member having one contact point to minimize the contact surface between the rotor and the drip pan, thereby reducing friction regardless of the contact surface.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
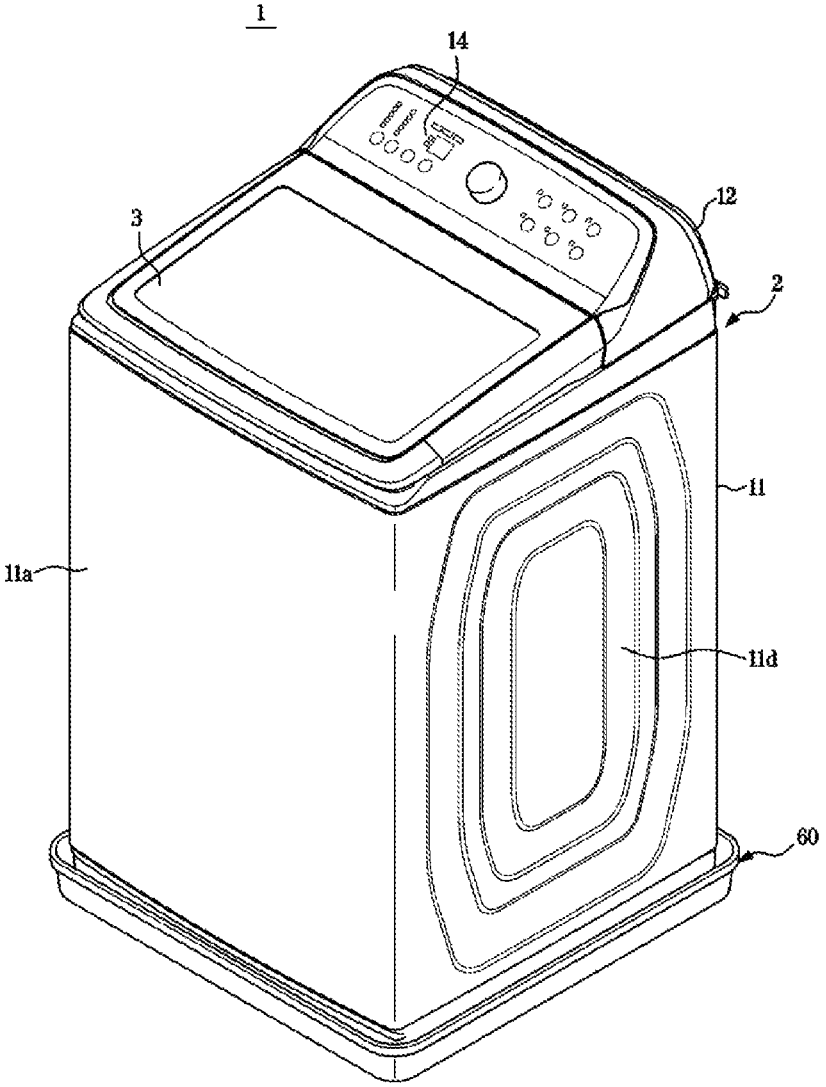
FIG. 1 is a view illustrating a washing machine according to an embodiment of the present disclosure.

Embodiments described in the disclosure and configurations shown in the drawings are merely examples of the embodiments of the disclosure and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, figures, steps, operations, elements, components, or combinations thereof, but do not preclude the presence or addition of one or more of the features, figures, steps, operations, elements, components, or combinations thereof.

It will be understood that, although the terms "first", "second", "primary", "secondary", etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

Hereinafter, various embodiments according to the disclosure will be described in detail with reference to the accompanying drawings.

Figure 2:
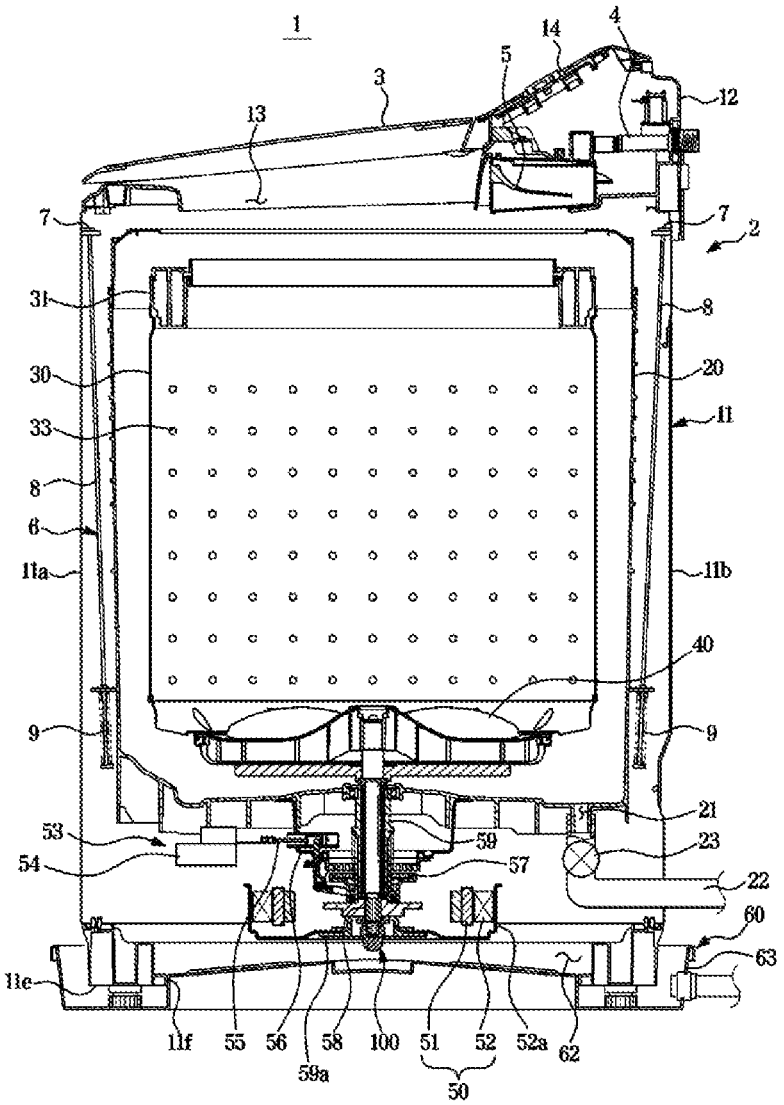
FIG. 2 is a side cross-sectional view schematically illustrating main components of the washing machine of FIG. 1.

FIG. 1 is a view illustrating a washing machine according to an embodiment of the present disclosure, and FIG. 2 is a side cross-sectional view schematically illustrating main components of the washing machine in FIG. 1.

As shown in FIGS. 1 and 2, a washing machine 1 may include a main body 2 forming the exterior thereof, a tub 20 disposed inside the main body 2, a rotating tub 30 rotatably provided inside the tub 20 and receiving laundry, and a pulsator 40 rotatably provided inside the rotating tub 30 to generate a washing water flow.

The main body 2 may include a cabinet 11 and a top cover 12 coupled to an upper portion of the cabinet 11. The top cover 12 is provided with an inlet 13 through which laundry may be inserted into the rotating tub 30, and the inlet 13 may be opened and closed by the door 3. The top cover 12 may be provided with a control panel 14 for displaying operating information of the washing machine 1 or for receiving an operating command.

The cabinet 11 may have a box shape. The cabinet 11 may include a front plate 11*a*, a rear plate 11*b*, a left side plate, a right side plate 11*d*, and a bottom plate 11*e*.

The tub 20 may have a cylindrical shape with an open upper surface to store washing water. The tub 20 may be suspended from the cabinet 11 by a suspension bar 8. The suspension bars 8 may be provided at four corners of the cabinet 11. The suspension bar 8 may each include a suspension bar 8 extending vertically, a suspension cap 7 provided to couple an upper end of the suspension bar 8 to the cabinet 11 and a lower end of the suspension bar 8 to the tub 20, a spring 9 provided to the lower end of the suspension bar 8 to reduce vibration of the tub 20. The spring 9 may reduce vibration of the tub 20 in a vertical direction.

A drain 21 may be formed in the lower portion of the tub 20 to drain washing water stored in the tub 20 to the outside of the tub 20. A drain hose 22 is connected to the drain 21, and a drain valve 23 may be provided on the drain hose 22 to open and close the drain hose 22.

The rotating tub 30 is rotatably provided within the tub 20 and may accommodate laundry. The rotating tub 30 may have a cylindrical shape with an open upper surface. A plurality of through holes 33 through which washing water flows in and out may be formed in the rotating tub 30. A balancing device 31 may be installed at an upper portion of the rotating tub 30 to eliminate load imbalance caused by laundry. The balancing device 31 may include a housing having an annular channel, and a ball or fluid mass movably provided within the channel. Accordingly, the balancing device 31 may resolve the load imbalance of the rotating tub 30 by moving the balls or fluid according to the rotation of the rotating tub 30.

The pulsator 40 may be rotatably provided at a lower portion of the rotating tub 30 to generate a washing water flow. The laundry may be washed by the washing water flow generated by the pulsator 40.

The washing machine 1 may include a water supplier 4 for supplying washing water to the inside of the tub 20. The water supplier 4 may include a water supply pipe connected to an external water supply source to guide the washing water to the tub 20, and a water supply valve (not shown) provided in the water supply pipe to control water supply.

The washing machine 1 may include a detergent dispenser 5 for supplying detergent. The washing water supplied through the water supplier 4 may pass through the detergent dispenser 5 to allow the detergent to be supplied to the tub 20 together with the washing water.

The washing machine 1 includes a driving device provided to rotate the rotating tub 30 and the pulsator 40.

The driving device may include a motor 50 provided to convert an electrical force into a mechanical rotational force, and a shaft system provided to transmit the driving force of the motor 50 to the pulsator 40 and the rotating tub 30.

The motor 50 may include a stator 51 and a rotor 52 electromagnetically interacting with the stator 51 to rotate.

The shaft system may include a spin-drying shaft 59 provided to transmit the driving force of the motor 50 to the rotating tub 30, a washing shaft 58 (hereinafter referred to as a shaft) provided to transmit the driving force of the motor 50 to the pulsator 40, and a clutch device 53 provided to connect or disconnect the motor 50 and the spin-drying shaft 59.

The spin-drying shaft 59 may be formed to have a hollow center, and the shaft 58 may be provided in the hollow center through the spin-drying shaft 59. The shaft 58 may remain connected to the rotor 52 of the motor 50, and the spin-drying shaft 59 may be connected to or disconnected from the rotor 52 of the motor 50 by the clutch device 53.

In response to the clutch device 53 disconnecting between the spin-drying shaft 59 and the motor 50, power may be transmitted only to the shaft 58 to rotate only the pulsator 40. Conversely, in response to the clutch device 53 connecting between the spin-drying shaft 59 and the motor 50, power may be transmitted to both the spin-drying shaft 59 and the shaft 58, thereby allowing the rotating tub 30 and the pulsator 40 to rotate simultaneously.

In the case where only the pulsator 40 rotates, the washing water flow may be generated by the rotation of the pulsator 40, and the laundry is rotated by the generated washing water flow and rubbed against the rotating tub 30, thereby performing washing of the laundry. In the case where both the pulsator 40 and the rotating tub 30 rotate, the laundry in the rotating tub 30 is rotated and moisture is removed from the laundry by a centrifugal force, thereby performing spin-drying of the laundry.

The clutch device 53 may include an actuator 54 provided to generate a driving force for power switching, a rod 55 provided to be moved linearly by an operation of the actuator 54, and a lever 56 connected to the rod 55 to pivot, and a coupling 57 coupled to the spin-drying shaft 59 to be raised and lowered according to an operation of the lever 56. The lowering of the coupling 57, causing it to be connected to the rotor 52, may allow the driving force of the motor 50 to be transmitted to the spin-drying shaft 59, and the raising of the coupling 57, causing it to be separated from the rotor 52, may allow the driving force of the motor 50 not to be transmitted to the spin-drying shaft 59.

During a spin-drying process, the rotating tub 30 may rotate at a high speed, and at this time, the rotating tub 30 may perform a precession depending on the weight imbalance of the laundry in the rotating tub 30. The precession of the rotating tub 30 may cause vibrations in the tub 20. The tub 20 may vibrate in the vertical and horizontal directions.

The suspension bar 8 described above may be provided to reduce vibrations in the vertical direction of the tub 20 by means of the suspension bar 8 formed longitudinally in the vertical direction and the spring 9 disposed at the lower end of the suspension bar 8.

The washing machine 1 may be provided with a drip pan 60 located at the lower portion of the main body 2 to receive water. The drip pan 60 may be provided to protect a floor, such as a wooden floor from moisture. The drip pan 60 may be provided at a lower portion of the cabinet 11 to receive water falling from the water supplier 4 or the washing machine 1. Although not shown in the drawings, the water stored in the drip pan 60 may be discharged to the outside through a separate flow path.

The drip pan 60 may be disposed at the lower portion of the main body 2 to cover the lower portion of the main body 2.

The washing machine 1 may include a friction member 100 mounted on a lower portion of the shaft 58 and provided to contact at least one surface of the drip pan 60.

In the washing machine 1 according to an embodiment of the present disclosure, when the weight of the rotating tub 30 is increased by the water and the laundry contained in the rotating tub 30, the tub 20 and the rotating tub 30 may move downwards while elastically being supported by the suspension bar 8. As the weight of the tub 20 and the rotating tub 30 is increasingly moved downward, the entire driving device, including the motor 50 and the shaft 58 connected to the rotating tub 30, may be moved downward. At this time, the rotor 52, which is provided to be rotatable among the driving device, may come into contact with the drip pan 60 provided in the lower portion of the main body 2, thereby generating noise accordingly.

As such, a friction member 100 may be provided on the rotor 52, which is moved downwardly by the increased weight of the tub 20 and the rotating tub 30, to form a gap G between the rotor 52 and the drip pan 60, thereby minimizing interference therebetween.

Hereinafter, the friction member 100 of the disclosure will be described in more detail.

Figure 3:
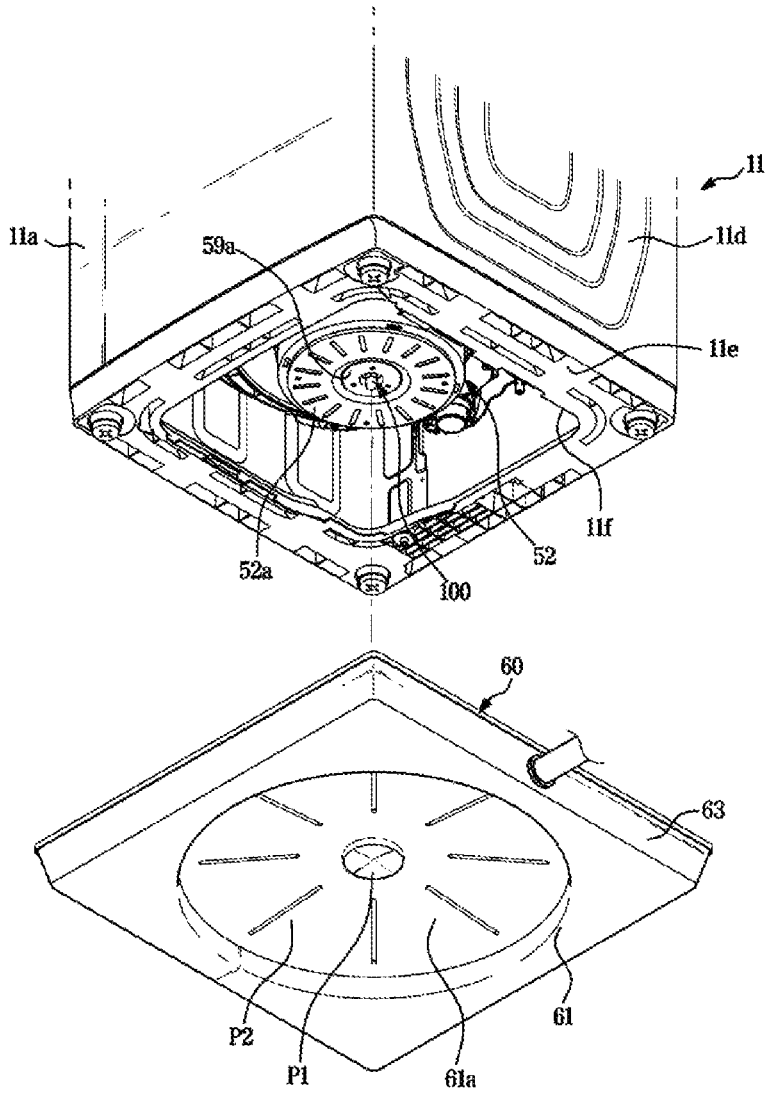
FIG. 3 is a perspective view illustrating a friction member arranged between a cabinet and a drip pan of the washing machine of FIG. 1.
Figure 4:
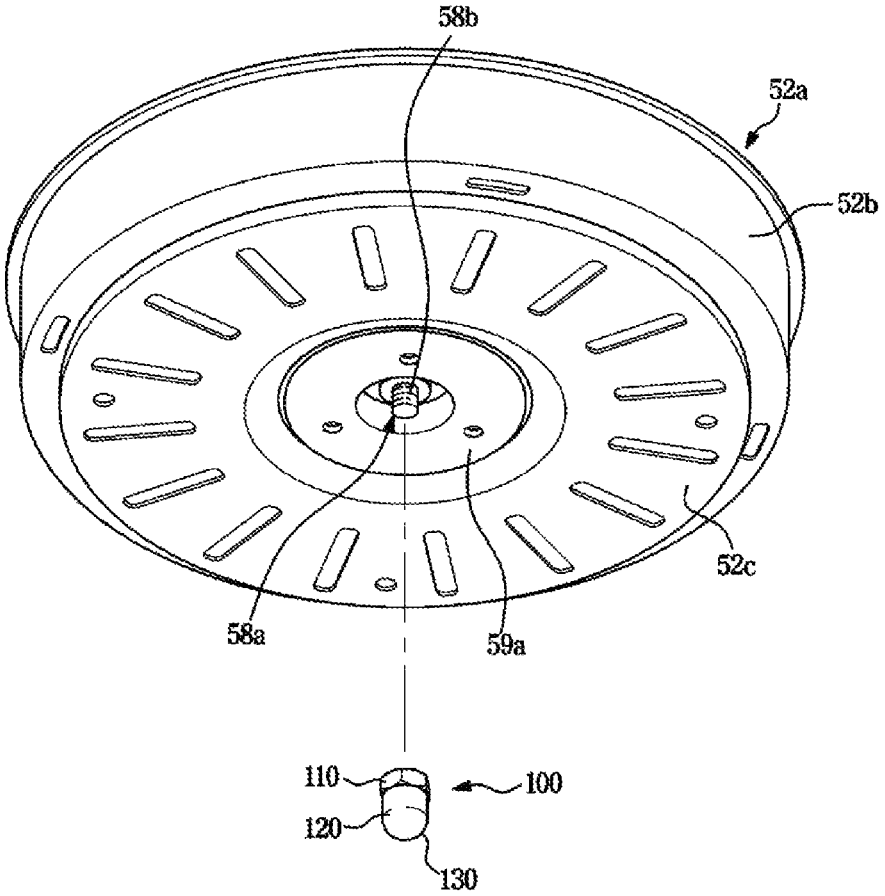
FIG. 4 is a perspective view illustrating the friction member disposed on a shaft of the washing machine of FIG. 1.
Figure 5:
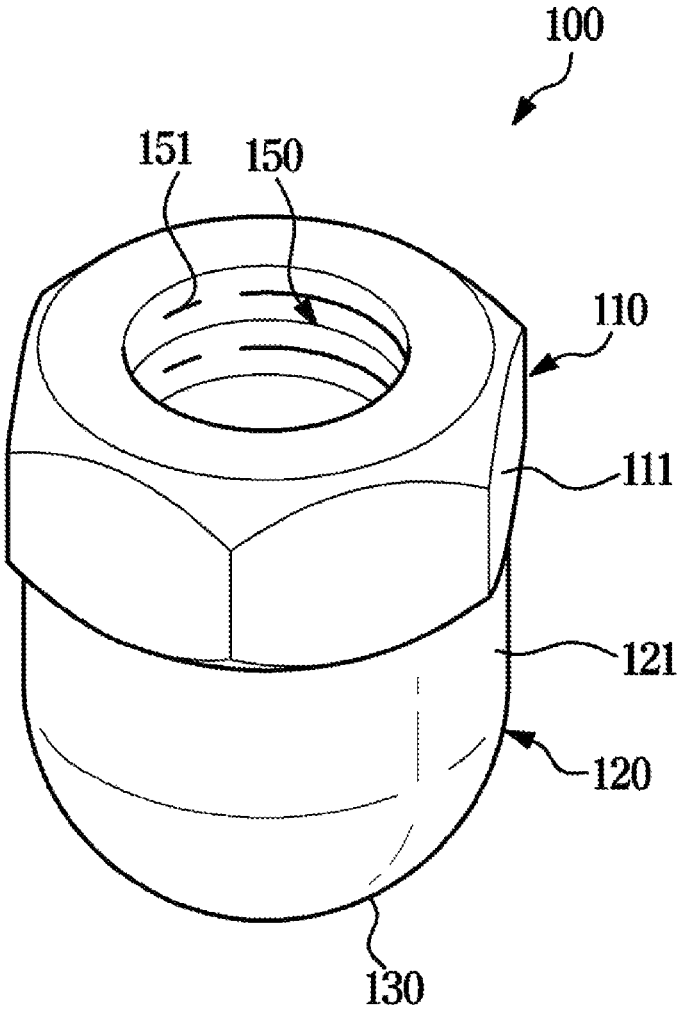
FIG. 5 is a perspective view illustrating the friction member according to an embodiment of the present disclosure.
Figure 6:
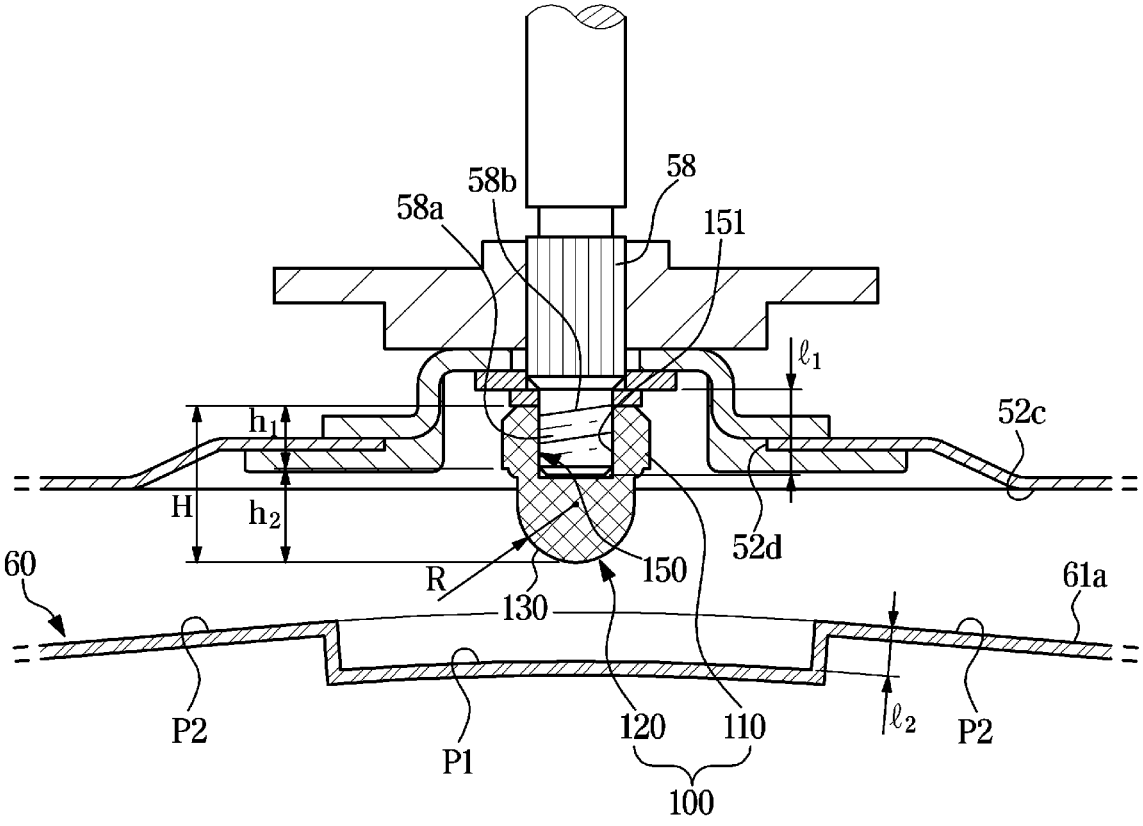
FIG. 6 is an enlarged cross-sectional view illustrating the friction member arranged between the shaft and the drip pan of the washing machine according to an embodiment of the present disclosure.

FIG. 3 is a perspective view illustrating the friction member arranged between the cabinet and the drip pan of the washing machine shown in FIG. 1, FIG. 4 is a perspective view illustrating the friction member installed on the shaft of the washing machine shown in FIG. 1, FIG. 5 is a perspective view illustrating the friction member according to an embodiment of the present disclosure, and FIG. 6 is an enlarged cross-sectional view illustrating the friction member installed between the shaft and the drip pan of the washing machine according to an embodiment of the present disclosure.

Referring to FIGS. 3 to 6, the friction member 100 may be installed on the lower portion of the shaft 58 of the driving device.

The friction member 100 may be positioned between the shaft 58 and the drip pan 60. The friction member 100 may be installed on the shaft 58 provided to rotate the rotating tub 30. The friction member 100 may be mounted on a lower end of the shaft 58. The friction member 100 may be installed to be rotatable together with the rotation of the shaft 58. The friction member 100 may be mounted on the lower end of the shaft 58 and provided to come into contact with at least one surface of the drip pan 60.

The friction member 100 may be coupled to a coupling portion 58*a* provided at the lower end of the shaft 58. The coupling portion 58*a* may include a first threaded portion 58*b* formed on at least a portion of the shaft 58. The coupling portion 58*a* may include the first threaded portion 58*b* formed in a longitudinal direction from the lower end of the shaft 58. The coupling portion 58*a* may be formed at the lower portion of the shaft 58 to have a first length 11. The coupling portion 58*a* may be formed at the lower end of the shaft 58 to have the first length 11.

The shaft 58 may be connected to the motor 50. The shaft 58 may be connected to the rotor 52. The rotor 52 may include a rotor frame 52*a* forming the exterior of the rotor 52.

The rotor frame 52*a* may be provided on an outer side of the rotor 52. The rotor frame 52*a* may have a cylindrical shape including a side wall 52*b* and a base 52*c*.

A through hole 52*d* may be formed in the center of the base 52*c*. The shaft 58 may be installed by passing through the through hole 52*d* of the base 52*c*. A bushing 59*a* coupled to the shaft 58 may be coupled to the through hole 52*d* of the base 52*c*.

An opening 11*f* may be formed in the center of the bottom plate 11*e* of the cabinet 11. The driving device, that is, the shaft 58, may be exposed through the opening 11*f* of the bottom plate 11*e*. The driving device to be connected to the tub 20 and the rotating tub 30 through the opening 11*f* formed in the bottom plate 11*e* may be moved in the vertical direction.

The shaft 58 may be provided to be movable in the vertical direction through the opening 11*f* formed in the bottom plate 11*e* of the cabinet 11. The friction member 100 installed at the end of the shaft 58 may be moved in the vertical direction through the opening 11*f* of the bottom plate 11*e*.

The friction member 100 may be moved in the vertical direction together with the vertical movement of the shaft 58. When moving downwardly, the friction member 100 may be provided to come into contact with the drip pan 60. When moving downwardly, the friction member 100 may be provided to come into contact with at least one surface of the drip pan 60. When moving downwardly, the friction member 100 may be provided to make point contact with the at least one surface of the drip pan 60 and may be provided to form the gap G between the at least one surface of the drip pan 60 and the rotor 52.

The friction member 100 may include a first portion 110 secured to the shaft 58, and a second portion 120 connected to the first portion 110 and having a curved surface 130 to contact one surface of the drip pan 60.

The first portion 110 of the friction member 100 may be provided to be coupled to the coupling portion 58*a* formed with the first length 11 at the lower end of the shaft 58. The first portion 110 of the friction member 100 may be formed to have a first height h1 corresponding to the first length 11. The first portion 110 may include a first portion body 111 forming the exterior. The appearance of the first portion 110 may be formed in a nut shape. The appearance of the first portion body 111 may be formed in a nut shape. The appearance of the first portion 110 may be formed to have a substantially hexagonal shape. The appearance of the first portion body 111 may be formed in a substantially hexagonal shape. In an embodiment of the present disclosure, the appearance of the first portion body is shown as an example of a hexagonal nut, but the spirit of the present disclosure is not limited thereto. For example, the appearance of the first portion body may include a square or octagonal nut.

The friction member 100 may further include a fixing groove 150 formed to be secured to the shaft 58. The fixing groove 150 may be formed by being recessed to the inside of the friction member 100. The fixing groove 150 may be formed in the first portion 110 and at least a portion of the second portion 120 of the friction member 100. The fixing groove 150 may be formed to correspond to the coupling portion 58*a*. The fixing groove 150 may be formed to have the first height h1 to correspond to the first length 11. A second threaded portion 151 corresponding to the first threaded portion 58*b* of the coupling portion 58*a* may be formed in the fixing groove 150. The second threaded portion 151 of the fixing groove 150 may be screw-coupled to the first threaded portion 58*b* of the coupling portion 58*a*.

The fixing groove 150 may be formed at an upper portion of the first portion 110. The fixing groove 150 may be provided within the first portion 110 to be secured to the coupling portion 58*a* of the shaft 58.

The second portion 120 of the friction member 100 may be formed to extend downwardly from the first portion 110. The second portion 120 of the friction member 100 may be formed to extend integrally from the first portion 110. The second portion 120 of the friction member 100 may include a second portion body 121 having the curved surface 130. The appearance of the second portion 120 may be formed in a hemispherical shape. The appearance of the second portion body 121 may be formed in a hemispherical shape. At least a portion of the second portion 120 may include the curved surface 130. At least a portion of the second portion body 121 may include the curved surface 130.

The second portion 120 of the friction member 100 may be positioned lower than the base 52*c* of the rotor frame 52*a*. The friction member 100 mounted on the end of the shaft 58 may be formed to protrude downwardly from the base 52*c* of the rotor frame 52*a* by as much as the second portion 120.

The second portion 120 of the friction member 100 may be formed to have a smooth surface. The second portion 120 of the friction member 100 may be provided to directly contact the drip pan 60.

The second portion 120 may be formed to extend downwardly from the first portion 110. A height h2 of the second portion 120 may be set to form the gap G between the base 52*c* of the rotor frame 52*a* and one surface of the drip pan 60.

A height ratio of the first portion 110 and the second portion 120 of the friction member 100 may be 1:1.5. The first height h1 of the first portion 110 of the friction member 100 may be formed to be lower than the second height h2 of the second portion 120. For example, in an embodiment of the present disclosure, the height of the first portion is 10 mm, the height of the second portion is 15 mm, and a curvature R of the curved surface is 8.5, but the spirit of the present disclosure is not limited thereto. The height ratio of the first and second portions of the friction member is 1.5 (15 mm/10 mm).

At least a portion of the second portion 120 may be provided to contact the drip pan 60. The at least a portion of the second portion body 121 may be provided to contact the drip pan 60. The curved surface 130 of the second portion 120 may be provided to contact the drip pan 60. The curved surface 130 of the second portion body 121 may be provided to contact the drip pan 60. The curved surface 130 of the second portion 120 may be provided to form one contact point 131 between the curved surface 130 and one surface of the drip pan 60. The curved surface 130 of the second portion body 121 may be provided to have one contact point 131 formed by point contact between the curved surface 130 and one surface of the drip pan 60. The contact point 131 may be formed by contact between the second portion 120 of the friction member 100 and the drip pan 60. In an embodiment of the present disclosure, the curved surface 130 of the second portion 120 is shown in a hemispherical shape as an example, but the spirit of the present disclosure is not limited thereto. For example, at least a portion of the second portion 120 in contact with the drip pan 60 may include the curved surface to form one contact point.

The drip pan 60 may be formed as a substantially square plate. The drip pan 60 may be formed in a shape corresponding to the main body 2 of the washing machine 1. The drip pan 60 may be formed in a size and shape corresponding to the cabinet 11. The drip pan 60 may be provided to cover the bottom plate 11*e* of the cabinet 11.

The drip pan 60 may include a body 61 and an edge portion 63 provided at an edge of the body 61. The body 61 of the drip pan 60 may include a square plate. The body 61 may be formed in a size and shape corresponding to the bottom plate 11*e* of the cabinet 11.

The body 61 of the drip pan 60 may form a receiving portion 62 to receive water falling from the washing machine 1. The receiving portion 62 may be formed on an upper surface of the body 61. The body 61 of the drip pan 60 may be provided to be elastically supported in the vertical direction. The body 61 of the drip pan 60 may be provided to be deformable in the vertical direction. The body 61 of the drip pan 60 may be provided to be inclined upwardly from the edge portion 63 formed at the edge toward the center.

The edge portion 63 of the drip pan 60 may be formed to extend upwardly from the edge of the body 61. The edge portion 63 may be formed to extend upwardly from an end of the edge of the body 61. The edge portion 63 may be formed with an outer end extending upwardly to allow the receiving portion 62 to be formed between the edge portion 63 and the body 61.

The drip pan 60 may include a first area P1 in contact with the friction member 100 and a second area P2 remaining except for the first area P1. The first area P1 of the drip pan 60 may be provided to contact the second portion 120 of the friction member 100.

The first area P1 of the drip pan 60 may be provided to contact the second portion 120 of the friction member 100. The first area P1 of the drip pan 60 may be located at the center of the body 61. The second area P2 of the drip pan 60 may be located anywhere except at the center of the body 61.

A plurality of beads 61*a* may be formed on the body 61 of the drip pan 60 to reinforce the strength of the drip pan 60. The plurality of beads 61*a* may be formed in the second area P2. The first area P1 and the second area P2 of the drip pan 60 may be formed at different heights.

The first area P1 of the drip pan 60 may be formed at a position lower than the second area P2 by a second length 12. The second length 12 may be less than the second height h2 of the second portion 120 of the friction member 100. The second length 12 may be equal to or less than the first height h1 of the first portion 110 of the friction member 100.

The height difference between the first area P1 and the second area P2 of the drip pan 60, which is as much as the second length 12, differs from the second height h2 of the second portion 120 of the friction member 100, which may be provided to form the gap G between the base 52*c* of the rotor frame 52*a* and one surface of the drip pan 60.

The gap G between the rotor frame 52*a* and the drip pan 60 may form the gap G between the rotor 52 and the drip pan 60, thereby preventing interference with the drip pan 60 during the rotation of the rotor 52.

Furthermore, the second portion 120 of the friction member 100, which is provided to make point contact with one surface of the drip pan 60, may minimize friction and thus prevent noise generation.

Figure 7:
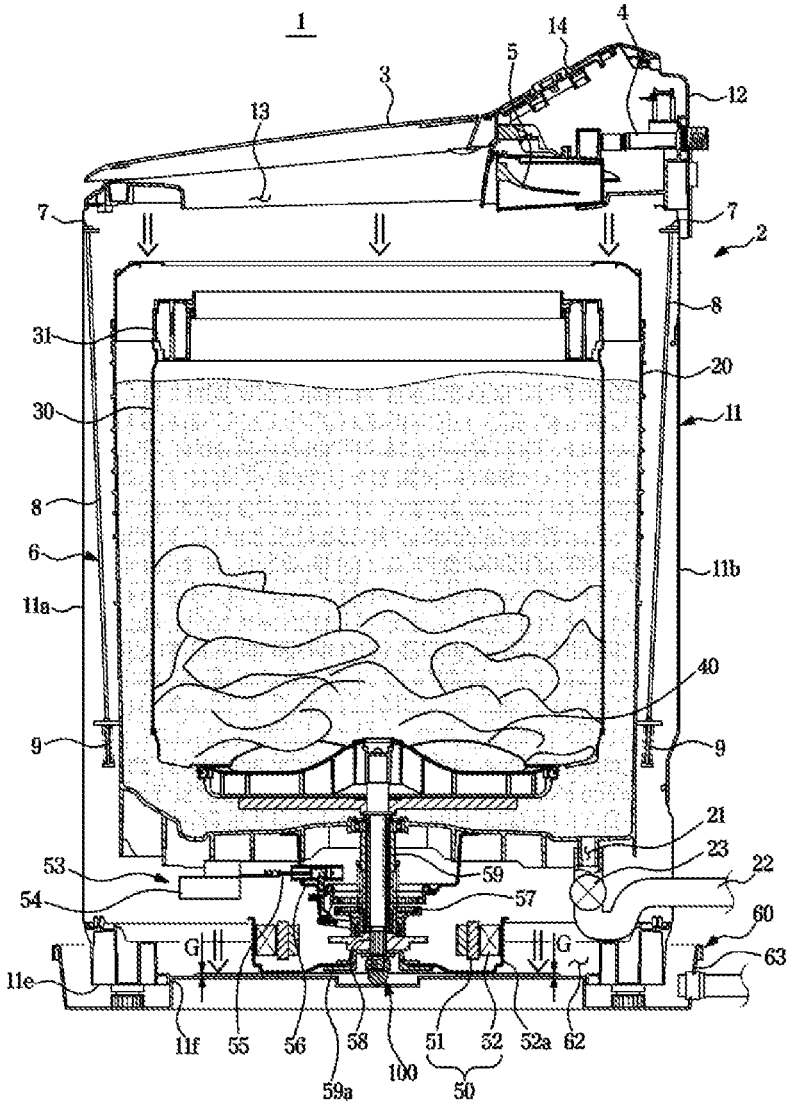
FIG. 7 is a view illustrating an operation of the friction member based on a movement of a tub of the washing machine according to an embodiment of the present disclosure.
Figure 8:
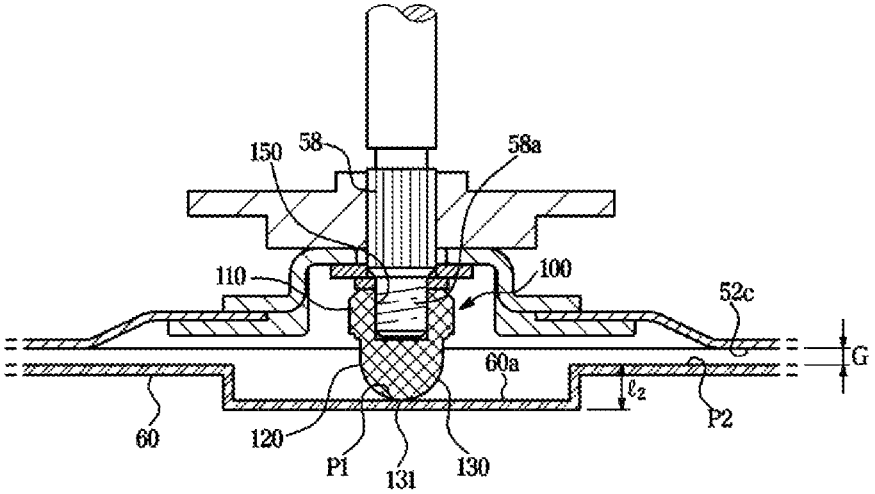
FIG. 8 is an enlarged view of FIG. 7, illustrating the operation of the friction member arranged between the shaft and the drip pan of the washing machine.

FIG. 7 is a view illustrating an operation of the friction member according to a movement of the tub of the washing machine according to an embodiment of the present disclosure, and FIG. 8 is an enlarged view of FIG. 7, illustrating the operation of the friction member installed between the shaft and the drip pan of the washing machine.

Referring to FIGS. 7 and 8, an operation of the friction member 100 will be described.

When water and laundry are introduced into the tub 20 and the rotating tub 30 of the washing machine 1, the weight thereof increases, and accordingly, the tub 20, the rotating tub 30, and the driving device including the shaft connected to the rotating tub 30 and the motor 50 may be moved downwardly.

The friction member 100 may be provided such that the first portion 110 is mounted at the lower end of the shaft 58 and the second portion 120 extends downwardly from the first portion 110.

The second portion 120 of the friction member 100 may be positioned such that the second portion 120 protrudes downwardly lower than the base 52*c* of the rotor frame 52*a* through which the shaft 58 is installed.

The friction member 100 may be disposed between the shaft 58 and the drip pan 60 and is provided to come into contact with the one surface 60*a* of the drip pan 60 when the driving device is moved.

The second portion 120 of the friction member 100 may be formed in a hemispherical shape with the curved surface 130, and the curved surface 130 may come into point contact with the one surface of the drip pan 60.

The drip pan 60 may be provided to be elastically deformable in the vertical direction, and when the body 61 of the drip pan 60 is positioned parallel to the floor, the second portion 120 of the friction member 100 may form the contact point 131 with the drip pan 60.

At this time, the gap Gas large as the second portion 120 of the friction member 100 may be formed between the rotor frame 52*a* and the drip pan 60. The gap G formed between the rotor 52 and the drip pan 60 may prevent interference between the rotor 52 and the drip pan 60 from being generated.

Furthermore, the second portion 120 of the friction member 100 may make one point contact with the first area P1 of the drip pan 60 through the curved surface 130 to form one contact point, so that the friction therebetween may be reduced, and the resulting noise generation may be reduced.

Figure 9:
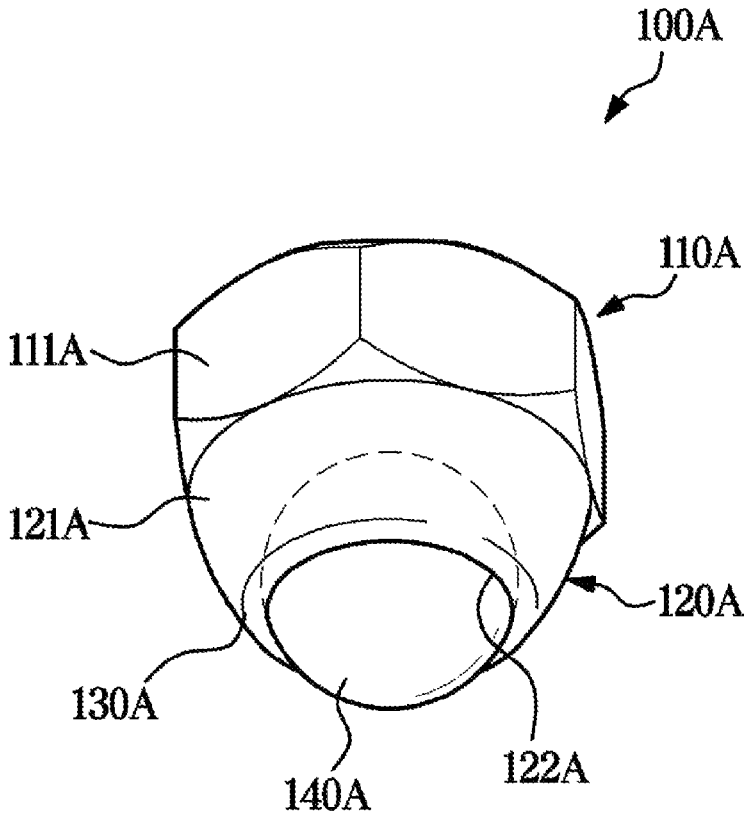
FIG. 9 is a perspective view illustrating a friction member according to another embodiment of the present disclosure.

FIG. 9 is a perspective view illustrating a friction member according to another embodiment of the present disclosure.

Referring to FIG. 9, a washing machine and a friction member provided therein according to another embodiment of the present disclosure will be described. Components identical to those of the above-described embodiment may be assigned the same reference numerals and the descriptions thereof may be omitted.

As shown in FIG. 9, a friction member 100A may include a first portion 110A connected to the coupling portion 58*a* of the shaft 58, and a second portion 120A extending downwardly from the first portion 110A.

The first portion 110A of the friction member 100A may be coupled to the coupling portion 58*a* formed with the first length 11 at the lower end of the shaft 58. The first portion 110A may include a first portion body 111A forming the exterior. The exterior of the first portion 110A may be formed in a nut shape. The exterior of the first portion body 111A may be formed in a nut shape. The exterior of the first portion 110A may have a substantially hexagonal shape.

The friction member 100A may further include the fixing groove 150 formed to be secured to the shaft 58. The fixing groove 150 may be formed by being recessed to the inside of the friction member 100A. The fixing groove 150 may be formed in the first portion 110A and at least a portion of the second portion 120A of the friction member 100A. The fixing groove 150 may be formed to correspond to the coupling portion 58*a*.

The second portion 120A of the friction member 100A may be formed to extend downwardly from the first portion 110A. The second portion 120A of the friction member 100A may be formed to extend integrally from the first portion 110A. The second portion 120A of the friction member 100A may include a second portion body 121A having a curved surface 130A. The exterior of the second portion 120A may be formed in a hemispherical shape. The exterior of the second portion body 121A may be formed in a hemispherical shape. At least a portion of the second portion 120A may include the curved surface 130A. At least a portion of the second portion body 121A may include the curved surface 130A.

The second portion 120A of the friction member 100A may be formed to have a smooth surface. The second portion 120A of the friction member 100A may be provided to directly contact the drip pan 60.

The second portion 120A may further include a ball 140A that is rotatable. A ball installation portion 122A may be formed in the second portion body 121A to allow the ball 140A to be rotatably installed. The ball installation portion 122A may be located at a lower portion of the second portion body 121A.

The ball 140A of the second portion 120A may be provided to directly contact one surface of the drip pan 60. The ball 140A of the second portion 120A may be provided to rotatably contact the one surface of the drip pan 60. The ball 140A of the second portion 120A may contact the one surface of the drip pan 60 to zero a contact force on the contact surface between the drip pan 60 and the friction member 100A, thereby preventing noise generation.

While the present disclosure has been particularly described with reference to exemplary embodiments, it should be understood by those of skilled in the art that various changes in form and details may be made without departing from the spirit and scope of the present disclosure.

What is claimed is:

1. A washing machine, comprising:

a cabinet including a bottom plate;

a tub provided in the cabinet;

a rotating tub rotatably provided in the tub;

a shaft connected to rotate the rotating tub;

a motor configured to rotate the shaft, the motor including a rotor and a stator;

a drip pan separate from the cabinet, the drip pan disposed around a lower end of the cabinet; and a friction member mounted on a lower end of the shaft and configured to contact with at least one surface of the drip pan;

wherein the friction member includes:

a first portion secured to the shaft, and a second portion connected to the first portion and having a curved surface in contact with the at least one surface of the drip pan.

2. The washing machine of claim 1, wherein:

the first portion is secured to a coupling portion having—a first length at the lower end of the shaft, and a height of the first portion corresponds to the first length.

3. The washing machine of claim 2, wherein:

the second portion extends downwardly from the first portion, and a height of the second portion forms a gap between the second portion and the at least one surface of the drip pan.

4. The washing machine of claim 3, wherein the second portion has a hemispherical shape.

5. The washing machine of claim 4, wherein the second portion further includes a contact point provided on at least a portion of the curved surface and formed by point contact with the at least one surface of the drip pan.

6. The washing machine of claim 5, wherein the second portion extends downwardly from the first portion, and further includes a rotatable ball.

7. The washing machine of claim 6, wherein the contact point is formed by contact between the rotatable ball and the one surface of the drip pan.

8. The washing machine of claim 6, wherein a height ratio of the first portion and the second portion is 1:1.5.

9. The washing machine of claim 3, wherein the drip pan includes:

a body provided corresponding to a lower portion of the cabinet to receive water falling from the cabinet; and an edge portion extending upwardly of an edge portion of the body;

wherein the body is inclined upwardly from the edge portion toward a center thereof.

10. The washing machine of claim 9, wherein the body is elastically supported in a vertical direction to be deformable.

11. The washing machine of claim 10, wherein the body includes:

a first area in contact with the friction member, and a second area as a remaining area of the body except for the first area.

12. The washing machine of claim 11, wherein the first area is a different height than the second area.

13. The washing machine of claim 12, wherein:

the first area is formed at a position lower than the second area by a second length, and the second length is less than a height of the second portion.

14. The washing machine of claim 13, wherein the second length is equal to or less than a height of the first portion.

15. A washing machine including:

a cabinet forming an exterior of the washing machine, the cabinet including a bottom plate;

a drip pan separate from the cabinet, the drip pan disposed around a lower end of the cabinet;

a tub provided within the cabinet;

a rotating tub configured to rotate within the tub;

a shaft connected to rotate the rotating tub;

a motor configured to rotate the shaft and including a rotor and a stator; and a friction member including a curved surface in contact with a surface of the drip pan.

16. The washing machine of claim 15, wherein the friction member includes:

a first portion secured to a lower end of the shaft, and a second portion connected to the first portion and having the curved surface in contact with the surface of the drip pan.

17. The washing machine of claim 16, wherein:

the first portion is provided to be secured to a coupling portion formed at a first length 11 at the lower end of the shaft, and a height h1 of the first portion corresponds to the first length.

18. The washing machine of claim 16, wherein:

the second portion extends downwardly from the first portion, and a height h2 of the second portion form a gap between the second portion and the surface of the drip pan.

19. The washing machine of claim 16, wherein the second portion has a hemispherical shape.

20. The washing machine of claim 16, wherein the second portion extends downwardly from the first portion and further include a ball which is rotatable.

* * * * *